United States Patent [19]

Suris

[11] Patent Number: 4,997,128

[45] Date of Patent: Mar. 5, 1991

[54] CASSETTE CASH BOX FOR CURRENCY VALIDATOR

[75] Inventor: Vladimir Suris, Mayfield Heights, Ohio

[73] Assignee: Ardac, Inc., Eastlake, Ohio

[21] Appl. No.: 389,977

[22] Filed: Aug. 7, 1989

[51] Int. Cl.[5] ..... B65D 91/00

[52] U.S. Cl. ..... 232/16; 232/1 D

[58] Field of Search ..... 232/7, 10, 15, 16

[56] References Cited

U.S. PATENT DOCUMENTS

| | | | |
|---|---|---|---|
| 4,313,601 | 2/1982 | Graef et al. | 232/1 D X |
| 4,840,368 | 6/1989 | Uehara | 232/1 D |
| 4,877,179 | 10/1989 | Baker et al. | 232/15 |
| 4,896,826 | 1/1990 | Bernier | 232/16 X |

*Primary Examiner*—Robert W. Gibson, Jr.

*Attorney, Agent, or Firm*—Renner, Kenner, Greive, Bobak, Taylor & Weber

[57] ABSTRACT

A cassette cash box for a currency validator prevents unauthorized removal of cash therefrom and evidences any attempt at such removal. The cash box is totally enclosed but for a front panel which has a window through which a punch can move. A continuous sleeve is maintained within the cash box, having a window corresponding to the window in the box itself. When the cash box is to be removed and replaced with a new one, a torsion spring within a barrel causes the continuous sleeve to rotate and lock in a position such that the sleeve window is at the rear of the cash box and a continuous sheet of material covers the cash at the window in the front panel of the box. The sleeve is constructed of a metallic or plastic film which readily evidences tampering or any attempts to make access to the currency within the box.

21 Claims, 3 Drawing Sheets

FIG.-1
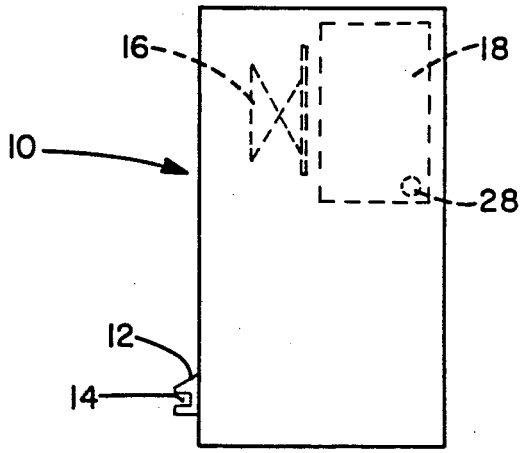
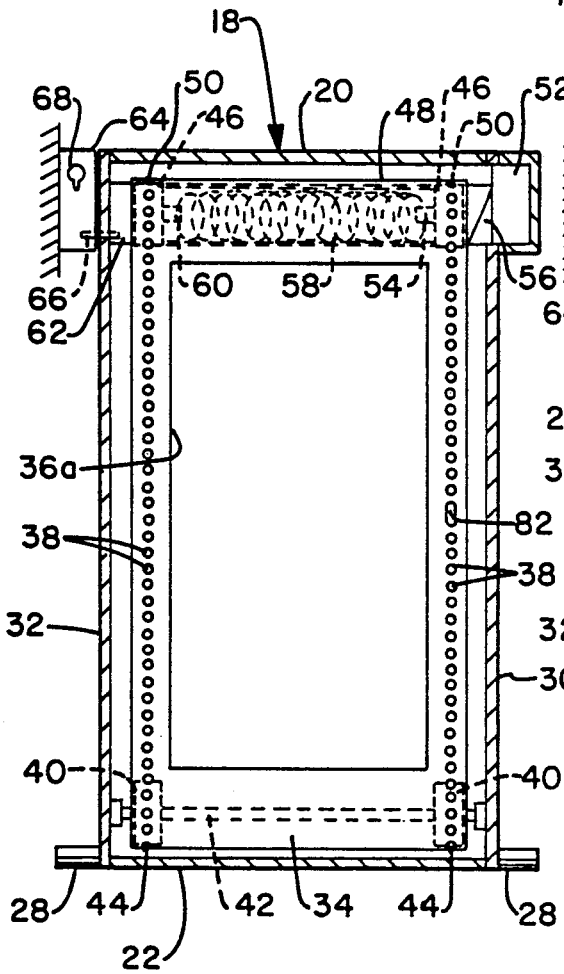
FIG.-2
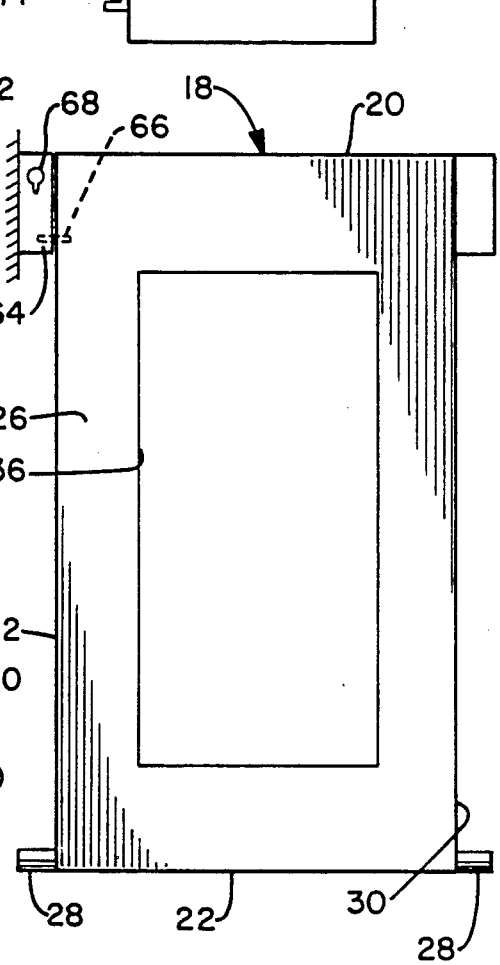
FIG.-3

CASSETTE CASH BOX FOR CURRENCY VALIDATOR

The invention herein resides in the art of currency validators and, more particularly, to a cassette cash box for the same. More particularly, the invention presents a cassette cash box which includes a tamper proof band or sleeve which encompasses and secures the cash box prior to removal from the currency validator such that unauthorized personnel cannot remove currency from the cash box.

BACKGROUND ART

Heretofore various types of currency validators have been known in the art. Such validators are typically either of the slot acceptor or tray acceptor types. In the former, a paper tendered as a piece of valid currency is entered into a slot in the front of the currency validator and is transported along a note path containing testing apparatus. If found to be valid, the paper is then punched or otherwise passed into a cash box. In a tray acceptor, the paper is placed on a tray which is then slid into a test position where it is temporarily locked. During the locked period, validation tests are conducted on the paper and, if found to be valid, the paper currency is passed to a cash box. Irrespective of the type of validator used, an accumulation of paper currency in the cash box results. Service personnel periodically access the validators,remove the currency, and replenish the coin supply for making requisite change.

It is well known that temptations often arise when individuals are exposed to the handling of cash. When the amount of paper currency removed from a currency validator is less than that for which change and/or services were rendered, it is uncertain whether the shortage is a result of dishonest personnel or an operative failure of the validator itself. The cause of such errors being difficult to isolate, it is most desirable to provide a cash box for currency validators which is tamper proof and which cannot be accessed by service personnel. With such apparatus, the temptation to service personnel is substantially removed, greatly limiting the likelihood of pilfering or the like.

DISCLOSURE OF INVENTION

In light of the foregoing, it is a first aspect of the instant invention to provide a cassette cash box for currency validators in which the cash box itself is totally removed from the validator and replaced with an empty one, rather than simply removing the cash therefrom.

Another aspect of the invention is the provision of a cassette cash box for a currency validator in which the cash box is secured and locked prior to removal from the validator such that service personnel cannot make access to the cash therein.

Yet another aspect of the invention is the provision of a cassette cash box for currency validators in which any attempt to make entry to the cash within the cash box may be readily detected.

An additional aspect of the invention is the provision of a cassette cash box for currency validators in which the cash box is easily and cost effectively constructed utilizing state of the art materials, apparatus and techniques.

The foregoing and other aspects of the invention which will become apparent as the detailed description proceeds are achieved by the improvement in a currency validator, comprising: a receptacle adapted for receipt by the currency validator, said receptacle comprising a box having an opening in one side thereof to accommodate a passage of currency thereinto from the validator; and closure means maintained by said receptacle for selectively closing and securing said opening.

Other aspects of the invention are attained by a cash box cassette for use in a currency validator, comprising: a box closed on five sides thereof, and having a window on a sixth front side thereof, said box defining a receptacle for receiving currency therein; and a continuous sleeve maintained about said receptacle and having a window therein adapted for positional registration with said window in said front side.

DESCRIPTION OF DRAWINGS

For a complete understanding of the objects, techniques, and structure of the invention, reference should be had to the following detailed description and accompanying drawings wherein:

FIG. 1 is a side illustrative view of a currency validator of the slot acceptor type, incorporating a cassette cash box according to the invention;

FIG. 2 is a front illustrative view of the cassette box of the invention with the front panel thereof removed, allowing a view of the inner workings thereof;

FIG. 3 is a front illustrative view of the cassette cash box of FIG. 1 with the front panel in place;

BEST MODE FOR CARRYING OUT THE INVENTION

Figure 4:
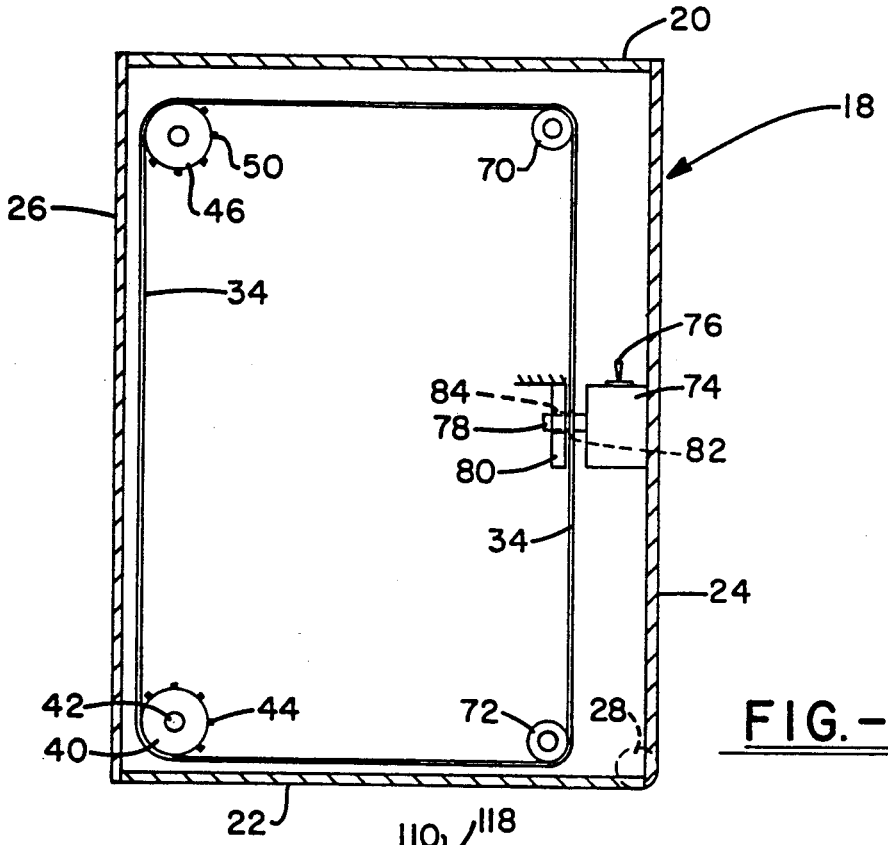
FIG. 4 is a side illustrative view of the cassette cash box of the invention as illustrated in FIG. 2.

Referring now to the drawings and more particularly FIG. 1, it can be seen that a currency validator is designated generally by the numeral 10. As presented above, slot acceptor and tray acceptor validators have been previously known and the concept of a cassette cash box for either is contemplated by the present invention. FIG. 1, however, illustrates a slot acceptor type of currency validator and the discussion herein will be had with respect to the same. It will, of course, be understood that the concepts and structure of the invention are equally applicable to the cash boxes for tray acceptors.

An escutcheon plate 12 is provided at a lower front end portion of the currency validator 10, such escutcheon having a slot 14 therein for receiving a piece of paper tendered as valid currency. This paper is transported from the slot 14 along a note path to a place in juxtaposition with a note punch 16. Having determined that the paper constitutes valid currency, the punch 16 is actuated to move the currency from the note path into a cash box 18. In the concept of the invention, the cash box 18 constitutes a cassette which may be totally removed and replaced within the currency validator 10.

As shown in FIGS. 2–4, the cassette cash box 18 comprises top and bottom panels 20, 22, a back panel 24, front panel 26, and a side panels 30, 32. It will be appreciated to those skilled inthe art that all of the panels, save the front panel 26, are of solid sheet or molded construction to cause the cassette cash box 18 to comprise an integral closed unit. The front panel 26 has a window 36 therein for receiving the punch 16 in reciprocating action therethrough such that the bills or currency may be "punched" thereinto. A pair of pins 28 extend from the lower back corners of the cash box 18 for purposes of making pivotal securing engagement of the cash box 18 within the currency validator 10 as will be discussed hereinafter.

Maintained within the cassette cash box 18 is a cylindrical sleeve or band 34, preferably of metallic film, plastic film such as MYLAR, or the like. The sleeve 34 is characterized by window 36*a* centrally positioned therein and of a size slightly larger than that of the note punch 16. It will be understood that the punch 16 reciprocates through the window 36 of the front panel 26 and the window 36*a* of the sleeve 34 to punch currency from the note path into the cash box 18. It will further be understood that the windows 36 and 36*a* are in registration with each other when the cash box 18 is positioned within the validator 10 to receive paper currency. It will also be seen that the continuous sleeve 34 is characterized by a plurality of tractor feed holes 36 about the edges thereof.

At the lower portion of the cassette cash box 18 is a pair of free wheeling tractor wheels 40 maintained upon an axle 42, each having lugs or teeth 44 engaging the tractor feed holes 38. At the top of the box 18, and in alignment with the wheels 40 is a pair of drive wheels 46, interconnected with each other by means of a barrel 48, and each having lugs or teeth 50 thereon for again engaging the tractor feed holes 38. It will be appreciated that the band 34 may comprise a timing belt such that the tractor feed holes are replaced with grooves and ridges that mate with ridges and grooves on the drive wheel 46, replacing the lugs or teeth 50. Further, the band 34 may be a friction belt, frictionally engaging and being driven by the wheels 46.

A motor 52 is connected to a shaft 54 which passes through the right drive wheel 46, but is not connected to the wheel 46 and is adapted for free rotation with respect thereto. A ratchet 56 is interposed between the motor 52 and the shaft 54 to prevent any reverse rotation of the shaft 52. In other words, the ratched 56 operates to lock the shaft 54 from rotation in one direction, while allowing such rotation in the other direction under control of the motor 52. Accordingly, the shaft 52 is unidirectionally rotatable.

A torsion spring 58 is interconnected between the motor-driven shaft 54 and the shaft 60 which is connected to the left drive wheel 46, which has a hub 62 connected thereto and rotatable therewith. A lock 64 having an appropriate locking means such as a plunger or pin 66 is adapted for engagement with the hub 62 to inhibit rotation of the left drive wheel 46. The lock 64 is fixedly secured to the validator 10 and adjacent the cassette cash box 18 when the cash box is inserted into the validator. A key hole or other actuating means 68 is provided for making and releasing the locking engagement attained by the plunger 66 received within a bore in the hub 62. Of course, such engagement and release may be attained by electronic means such as a solenoid or the like, as well as the mechanical means just described. Further, any suitable type of key or actuating means may be employed, the key hole 68 being shown solely for illustrative purposes.

As shown in FIG. 4, free wheeling pairs of rollers 70, 72 are placed at the back of the cassette cash box 18 and in alignment with respective paris of lug wheels 46,40. It will be understood that the pairs of rollers 70, 72 may each comprise a single elongated roller, of a length substantially equal to the width of the box 18. If desired the rollers 70, 72 may also be provided with lugs to engage the holes 38 to achieve further secured engagement of the sleeve 34. The sleeve 34 passes about the wheels and rollers as shown, the area defined within the sleeve constituting the receptacle area for receipt of paper currency as deposited therein by the punch 16.

Maintained at the back of the cash box 18 is a plunger 74 having an actuation switch 76 which may be operatively connected to the lock and key mechanism 64–68. Again, the actuation of the plunger 74 may be obtained mechanically or electronically as by means of a solenoid or the like. In either event, actuation of the plunger 74 causes a pin 78 to extend therefrom, and into a hole 84 within a fixed plate 80 maintained within the cash box 18. The pin 78 and plate 80 are in alignment with the right edge of the sleeve 34 as shown in FIG. 2, which edge includes an enlarged hole 82 in the tractor hole path. As will be described hereinafter, the pin 78 makes engagement through the hole 82 within the sleeve 34 and into the hole 84 of the plate 80. Such actuation thus locks the sleeve 34 such that no further rotational movement can be made.

In use, the cassette cash box 18 is positioned into a cavity or mating receptacle within the validator 10, with the pins 28 being received in appropriate slots, grooves or appropriate recesses. The cash box 18 is then pivoted into position and secured therein by an appropriate locking means. Such locking means may include the lock assembly 64–68, or may be separate and distinct from the same. In any event, with the cash box 18 in place, the operator actuates the plunger or pin 66 by means of an appropriate key, causing the hub 62 and wheels 46 and sleeve 48 to lock in position. This locking technique, or other suitable mechanism, also causes the motor 52 to actuate for a short period of time such as 10–30 seconds, rotating the pin 54 and thereby loading the torsion spring 58. Accordingly, the barrel 48 contains therein a torsion spring 58 which is loaded to cause the sleeve 34 to rotate. It is, however, prevented from rotating due to the locked posture of the hub 62 by the pin 66.

When the cash box cassette 18 is to be removed and replaced with an empty one, the operator simply actuates the lock 64 by insertion of an appropriate key into the key hole 68, or by appropriate electronic actuation in the case of a solenoid. Such actuation of the lock releases the barrel 48 to rotate under the urging of the torsion spring 58, causing the sleeve 34 to pass until the window 36 is at the closed rear portion of the cash box 18, in juxtaposition to the back panel 24. The plunger lock 74, actuated in conjunction with the actuation of the lock 64 by electronic or mechanical linkage 76, causes the pin 78 to be urged against the moving edge of the sleeve 34 and to engage the enlarged hole 82 as it passes thereby. Engagement of the pin 78 through the enlarged hole 82 and through the hole 84 in the plate 80 thus locks the sleeve 34 and prevents any additional rotational movement thereof.

It will thus be seen that when the cash box 18 is removed from the validator 10, a metallic or tough plastic sleeve totally encases the cash preventing any access thereto. The window in the sleeve 34 is, at this time, positioned at the back panel 24. Release of the locking pin 78 can only be accomplished by means of an appropriate key or electronic actuation, which can be achieved only at a centralized location to which service personnel return the cash boxes. Accordingly, no tampering by the service personnel in the field is possible, with the integrity of the entire apparatus being greatly increased. Should any tampering with the sleeve 34 be attempted, the same will be readily apparent in the nature of mars, cuts, or folds in the sleeve itself.

Figure 5:
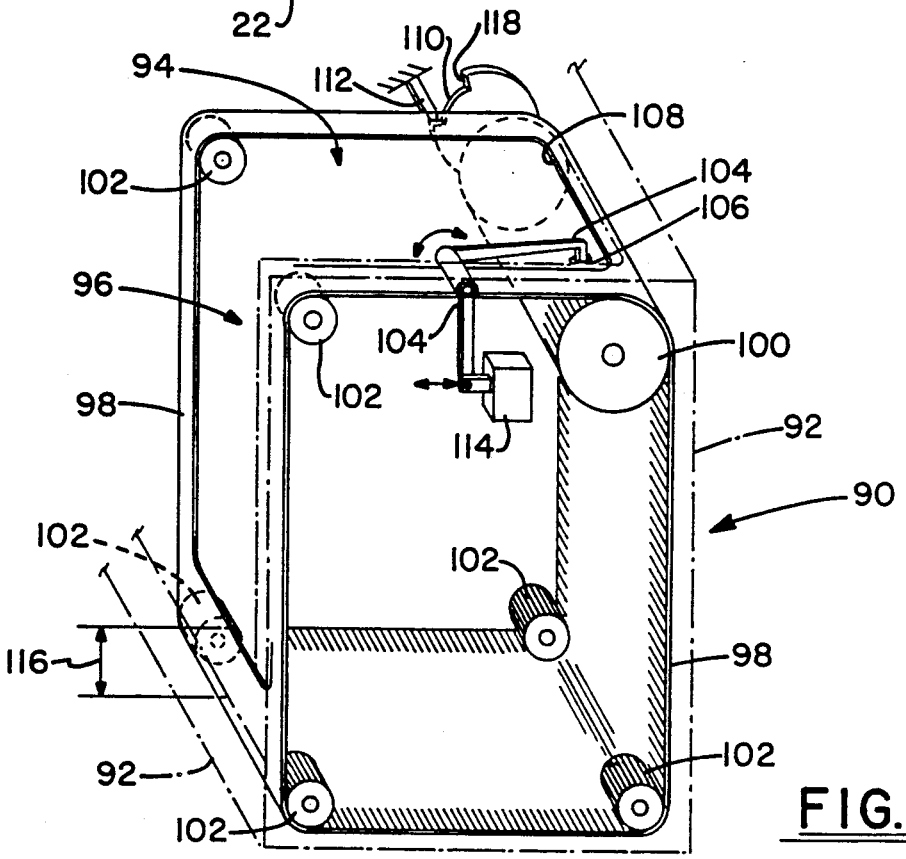
FIG. 5 pictorially and schematically illustrates a cassette cash box according to a second embodiment of the invention.

With reference now to FIG. 5, a second embodiment of a cassette cash box can be seen as designated by the numeral 90. The cash box 90 is defined by a housing 92, preferably molded plastic or metallic, and is adapted for implementation with the currency validator 10 of FIG. 1. As will be readily appreciated by those skilled in the art, the housing 92 comprises a pair of side panels, a back panel, and a bottom panel, all of which are of substantially solid material. The front and top of the housing 92 are generally open as at 94 and 96 to accommodate the punching of currency thereinto via the opening 96 in the front of the housing 92, and removal of currency therefrom via the opening 94 in the top.

A continuous belt 98 wraps about the housing 92 of the cassette cash box 90. The belt 98 includes an opening therein which is substantially equivalent to the aggregate of the openings in the top and front of the housing 92. Further, the belt 98 includes drive means along the peripheral edges thereof such that the belt 98 may be in driven engagement with a spring barrel 100. Preferably, the belt 98 comprises a timing belt having a plurality of equally spaced grooves and/or ridges extending thereacross for mating engagement with corresponding ridges and/or grooves at least at the peripheral edges of the spring barrel 100. It will, of course, be understood that the spring barrel 100 maintains therein a torsion spring to operate in similar fashion to the spring barrel 48 of FIG. 2, achieving movement and transport of the belt 98.

With the spring barrel 100 positioned at one of the corners of the housing 92, complimentary wheels or rollers 102 are maintained at the three remaining corners, one on each side thereof. The wheels or rollers 102 have teeth or ridges thereon in mating engagement with the corresponding ridges or teeth of the belt 98. As will be understood by those skilled in the art, the wheels or rollers 102 are free wheeling and are provided for purposes of facilitating movement of the belt 98 about the housing 92.

A linkage 104 is pivotally mounted on the housing 92 for selective engagement with a hole 106 in the spring barrel 100. As shown, the hole 106 is near, but slightly ahead of, the trailing edge of the opening of the belt 98. With a front tab of the linkage 104 engaging the hole 106, rotational movement of the spring barrel 100 is inhibited. In like manner, when the linkage 104 is retracted from the hole 106, the barrel 100 is allowed to rotate, causing the belt 98 to travel about the housing 92.

Attached to one side of the spring barrel 100 and rotated therewith is a cam lock wheel 110, having an abutment or the like extending therefrom for engagement with a stop 112 which is attached to the currency validator adapted for receiving cassette cash box 90. The stop 112, when in engagement with the abutment of the cam lock wheel 100, prevents rotation of the spring barrel 100. In contradistinction, actuation of solenoid 114 disengages the linkage 104 from the hole 106 of the barrel 100, allowing the barrel to rotate. Electrical actuation of the solenoid 114 is achieved by interconnection of the cash box 90 with a receiving currency validator.

In operation, with the cash box 90 removed from the currency validator, the spring barrel 100 is rotated until the front tab of the linkage 104 drops into the hole 106 of the spring barrel 100. At this time, the spring of the spring barrel 100 is loaded by appropriate torquing or rotational movement thereof. At this point in time the opening of the continuous belt 98 is in the position shown in FIG. 5, extended less than the full distance necessary to allow passage of the reciprocating punch when inserted into a currency validator. As shown in FIG. 5, the portion 116 of the belt 98 blocks the window opening for the punch. At the same point in time, the cam lock wheel 110 is in the position shown in FIG. 5 such that a lowermost portion of its cam surface will engage the stop 112 of the currency validator when the cassette cash box 90 is inserted therein. Upon such insertion, appropriate electrical contact is made between the cash box 90 and receiving currency validator such that the solenoid 114 is actuated, lifting the linkage 104 from engagement with the hole 106 of the spring barrel 100. The torsion spring of the barrel 100 thus causes the barrel to rotate, moving the belt 98 the distance allowed by the stop 112 riding on the cam surface of the wheel 110 until it hits the abutment 118 thereof. During this exercise, the belt 98 has moved the distance 116 necessary for bringing the opening of the belt into registration with the punch of the currency validator. Accordingly, the cassette cash box 90 is received by the currency validator and is adapted for receipt of paper currency punched therein. Of course, an appropriate mechanical lock is activated to secure the cash box 90 in the currency validator.

At an appropriate service interval, a serviceman simply unlocks the back of the currency validator 10, grasps the back of the cash box 90, and begins to remove the same. This breaks electrical contact such that the solenoid 114 becomes deactivated, urging the tab of the linkage 104 against the belt which has come into registration with the tab when movement of the belt opening into the area 116 was exercised as presented above. Similarly, such removal disengages the stop 112 from the abutment 118, allowing the spring barrel 110 to rotate and to similarly rotate the timing belt 98. The timing belt quickly rotates such that the solid portion thereof now blocks the openings 94, 96 of the housing 92, the opening of the belt 98 now being along the closed back of the housing 92 as well as the rear portions of the top and bottom thereof. The length of the belt 98 and the diameter of the barrel 100 are such that when the leading edge of the opening of the belt 98 passes the tab of the linkage 104, that tab will then fall into the hole 106 of the spring barrel 100, preventing any further movement thereof. Accordingly, the belt 98 is then locked in position and cannot move further, sealing the front and top openings of the housing 92 to prevent any access to the interior thereof for removal of currency or the like. Only an operator can then actuate the solenoid 114 to further disengage the spring barrel 100 to allow for movement of the belt to a point where access to the interior of the housing 92 may be made. Upon removal of the currency by authorized personnel, the spring barrel 100 is again loaded, the linkage 104 is caused to engage the hole 106 and the cassette 90 is prepared for subsequent engagement into an appropriate currency validator 10.

Figure 6:
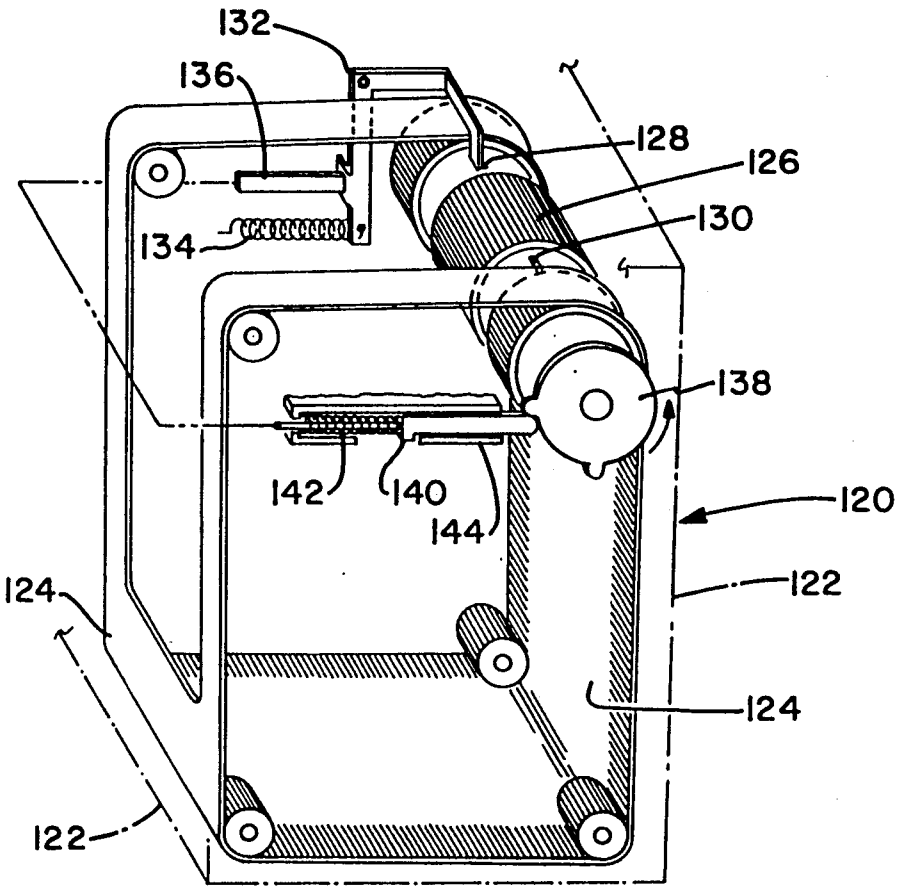
FIG. 6 pictorially and schematically illustrates a cassette cash box according to third embodiment of the invention.

With reference now to FIG. 6, an embodiment of the invention similar to that of FIG. 5 is shown, but eliminating the need for electrical actuation of the solenoid 114. As shown, a cassette cash box 120 is defined by a housing 122, again substantially enclosed on four of the six sides thereof. A continuous belt 124, preferably in the nature of a timing belt having teeth along the lateral edges thereof, engages and is driven by a spring barrel 126 having teeth thereon for mating with the belt 124. The spring barrel 126 is characterized by a pair of parallel circumferential grooves, having respective holes 128, 130 therein.

A linkage 132 is pivotally mounted on the housing 122, interconnected to the housing by a biasing spring 134 at one end thereof, and having a tab at the opposite end in registration with the groove of the spring barrel 126 characterized by the hole 128. It will be readily appreciated that when the hole 128 is exposed through the open window of the belt 124, the spring 134 urges the linkage 132 to pivot such that the tab thereon engages with the hole 128 and inhibits any rotational movement of the barrel 126. A release pin 136 is provided as part and parcel of the currency validator adapted to receive the cash box 120 and is so positioned as to engage the linkage 132 when the cash box is positioned into the currency validator, thereby releasing the engagement of the linkage 132 with the hole 128, allowing the barrel to rotate if not otherwise restrained.

Provided on the opposite end of the spring barrel 126 is a cam lock wheel 138 having an abutment extending from a circumferential surface thereof. When the cash box 120 is entered into the currency validator, rotation of the barrel 126 is inhibited by engagement of the linkage 132 with the hole 128. Prior to engagement of the release pin 136 with the linkage 132, the pin stop 140, biased by a spring 142 and riding in a guide 144, makes contacting engagement with the circumferential surface of the wheel 138. Accordingly, when the barrel 126 is released to rotate, the rotation will be next inhibited when the abutment of the wheel 138 engages the pin stop 140. The result is the exercising of the belt 124 to move the window thereof to be in registration with the punch of the currency validator as discussed above with respect to FIG. 5. This exercising technique assures that the spring barrel 126 and belt 124 are operative, capable of movement, and have not been jammed or otherwise restricted. Accordingly, with the cassette 120 in place, the belt window is in alignment with the validator punch, the linkage 132 is disengaged from contact with the belt by means of the pin 136, and movement of the barrel is inhibited by engagement of the projection of the wheel 138 with the pin stop 140.

At a regular service interval, an authorized individual removes the cassette cash box 120 from the currency validator and, immediately upon commencement of such removal, the belt 124 is caused to rotate about the housing 122 such that the openings in the top and front portions of such housing are enclosed by the solid portion of the belt, the window of the belt being now maintained at the back of the housing. This feature is achieved in somewhat the same manner as with the structure of FIG. 5. Slight withdrawal of the cash box 120 from engagement with the currency validator disengages the wheel 138 from the stop pin 140, allowing the barrel 126 to rotate, driving the belt 124 with the tab of the linkage 132 riding thereon. The belt rotates until the leading edge of the belt window exposes the hole 130, at which time the lock spring 150 engages the hole 130. The details of such removal are presented directly below.

Figure 7:
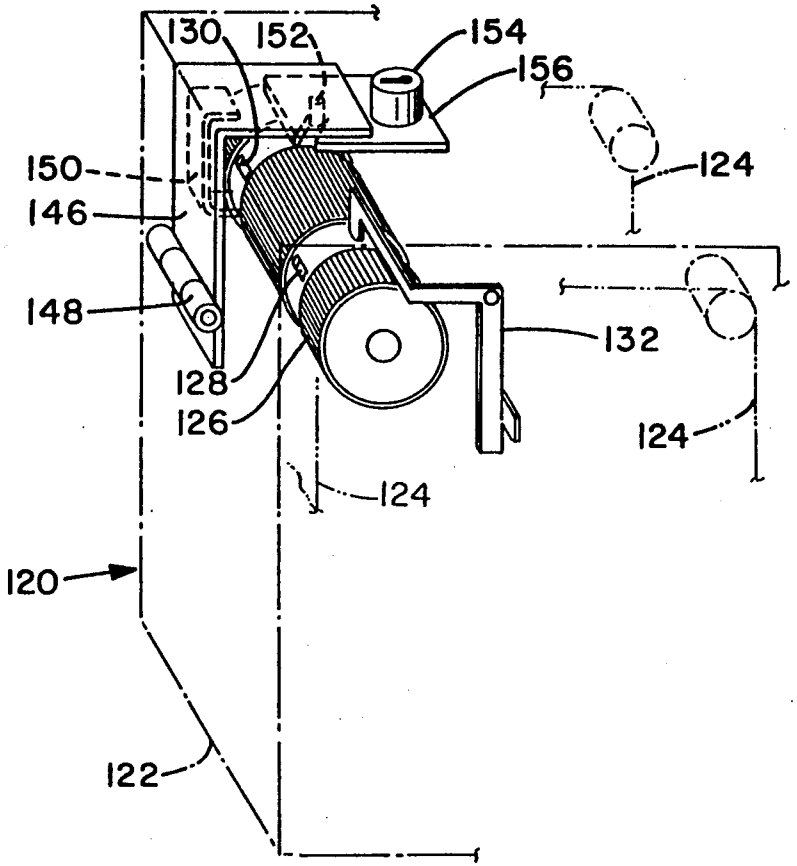
FIG. 7 is a pictorial and schematic rear view of the embodiment of FIG. 6, showing the security locking system thereof.

Securement and locking of the belt 124 and barrel 126 is achieved by a unique lock arrangement which can be accessed only by a security officer of the service company. As shown in FIG. 7, the housing 122 of the cassette cash box 120 includes a door 146 connected by hinge 148 at the back thereof. The door 146 carries a lock spring 150 which is in alignment with the groove of the spring barrel 126 having the hole 130 therein. The lock spring is simply a piece of spring metal having an inwardly bent tab which is adapted to ride upon the belt or within the groove, whichever is exposed, until engagement can be made with the hole 130. A lock pin 152 is also carried by the door 146 and is adapted for locking engagement by means of a lock blade 156 of the lock 154. Only authorized personnel would, of course, have a key for accessing the lock 154.

With an understanding of the structure of FIG. 7, it can now be appreciated that when the stop pin 140 disengages the wheel 138 and the barrel 126 begins to rotate under torsion spring force, the lock spring 150 rides on the belt 124 until the leading edge of the belt window exposes the groove containing the hole 130. The spring 150 snaps into the groove and, immediately upon contact with the hole 130, makes engagement therewith and locks the barrel 126 from further rotation. Accordingly, the belt 124 and barrel 126 are locked in a position with the belt totally obscuring the openings of the housing 122 until an authorized security officer can open the door 146 via the lock 154. Opening of the door 146 disengages the lock spring 150 from the hole 130 of the barrel 126, allowing the belt of rotate further until the linkage 132 can engage the hole 128, exposing the openings and allowing removal of currency contained within the cassette cash box 120. At this point in time, the torsion spring of the barrel 126 can be reloaded and the empty cash box can be reinserted into an appropriate currency validator.

As shown, the belt 124 is configured to inhibit and enable engagement of the linkage 132 with the hole 128, and that of the lock spring 150 with the hole 130, while providing the requisite openings for a punch or access to authorized personnel for removal of currency. Where there is no window in the belt, both holes 128 and 130 are blocked from locking engagement. Where the window is most narrow, the hole 128 is blocked, but engagement of the hole 130 by the lock spring 150 may be achieved. Finally, where the window is the widest, the hole 128 is exposed for engagement by the linkage 132. As presented above, the belt is so configured as shown that engagement at 128, 132 secures the barrel 126 for placement into the currency validator, while engagement at 150, 130 secures the cassette cash box 120 for removal from the currency validator.

Thus it can be seen that the objects of the invention have been satisfied by the structure presented hereinabove. While in accordance with the patent statutes only the best modes and preferred embodiments of the invention have been presented and described in detail, it is to be understood that the invention is not limited thereto or thereby. Accordingly, for an appreciation of the true scope and breath of the invention, reference should be had to the following claims.

What is claimed is:

1. The improvement in a currency validator, comprising:

a receptacle adapted for receipt by the currency validator, said receptacle comprising a box having an opening in one side thereof to accommodate a passage of currency thereinto from the validator; and closure means maintained by said receptacle for selectively closing and securing said opening, said closure means comprising a sleeve having an opening therein in selective registration with said opening in said one side of said receptacle.

2. The improvement in a currency validator as recited in claim 1, which further comprises first means for securing said receptacle within the currency validator.

3. The improvement in a currency validator as recited in claim 2, wherein said closure means is activated to close and secure said opening by disengagement of said first means to release said receptacle from the currency validator.

4. The improvement in a currency validator as recited in claim 1, wherein said closure means further comprises drive means engaging said sleeve for selectively rotating said sleeve to open and close said opening in said one side of said receptacle.

5. The improvement in a currency validator as recited in claim 4, wherein said drive means comprises a roller engaging and transporting said sleeve.

6. The improvement in a currency validator as recited in claim 5, wherein said closure means further comprises locking means for engaging said sleeve and preventing further movement thereof after said sleeve has been transported by said roller to a predetermined position.

7. The improvement in a currency validator as recited in claim 6, wherein said drive means further comprises a spring, biased to impart rotational force to said roller.

8. The improvement in a currency validator as recited in claim 7, wherein said drive means comprises:

a first pair of rollers interconnected by a barrel receiving said spring therewithin; and a second pair of rollers positioned in alignment with and spaced from said first pair of rollers, said sleeve passing over said first and second pairs of rollers.

9. The improvement in a currency validator as recited in claim 8, wherein said drive means further comprises a motor operatively connected to said spring for biasing said spring upon receipt of said receptacle by the currency validator.

10. The improvement in a currency validator as recited in claim 8, wherein said locking means comprises a member in selective engagement with a hole in said barrel.

11. The improvement in a currency validator as recited in claim 10, wherein said member is spring biased, riding on said sleeve during periods of said rotating of said sleeve, said sleeve preventing engagement of said member with said hole.

12. The improvement in a currency validator as recited in claim 11, wherein said member engages said hole when said opening of said sleeve exposes said hole to said member.

13. The improvement in a currency validator as recited in claim 8, wherein said locking means comprises a surface connected to and rotatable with said barrel and a pin in juxtaposition to said surface, engagement of said pin with said surface inhibiting rotation of said barrel, and disengagement of said pin from said surface allowing rotation of said barrel.

14. A cash box cassette for use in a currency validator, comprising:

a box closed on five sides thereof, and having a window on a sixth front side thereof, said box defining a receptacle for receiving currency therein; and a continuous sleeve maintained about said receptacle and having a window therein adapted for positional registration with said window in said front side.

15. The cash box cassette according to claim 14, further comprising drive means for rotating said sleeve about said receptacle to selectively close said window in said front side with said sleeve.

16. The cash box cassette according to claim 15, further comprising locking means for selectively securing said sleeve at a predetermined position and preventing further rotational movement thereof.

17. The cash box cassette according to claim 16, wherein said drive means further comprises first and second paris of opposed wheels engaging said sleeve, said first pair being interconnected by a barrel enclosing a biasing spring.

18. The cash box cassette according to claim 17, wherein said drive means further comprises a motor operatively connected to said spring for imparting a bias thereto.

19. The cash box cassette according to claim 16, further comprising first means for securing and releasing said box to and from the currency validator.

20. The cash box cassette according to claim 19, wherein actuation of said first means to release said box from the currency validator actuates said drive means to rotate said sleeve to close said window in said front side.

21. The cash box cassette according to claim 20, wherein actuation of said first means to release said box from the currency validator actuates said locking means for securing said sleeve at said predetermined position.

* * * * *